United States Patent [19]

D'Andrade et al.

[11] 4,225,140

[45] Sep. 30, 1980

[54] TARGET-TYPE SHOOTING TOY

[76] Inventors: Bruce M. D'Andrade, Box 130E, R.D. #7, Flemington, N.J. 08822; Kwok W. Tsui, 13 Tai Yuen St.G/F, WanChai, Hong Kong

[21] Appl. No.: 937,487

[22] Filed: Aug. 28, 1978

[51] Int. Cl.[3] ..... A63F 7/00

[52] U.S. Cl. ..... 273/356; 273/382; 273/397; 273/DIG. 26; 124/37; 124/53

[58] Field of Search ..... 273/101, 103, DIG. 26, 273/102.1 B, 102.1 C, 102.1 E; 124/53, 37

[56] References Cited

U.S. PATENT DOCUMENTS

| | | | |
|---|---|---|---|
| 599,063 | 2/1898 | McCauley | 273/102.1 E |
| 1,369,084 | 2/1921 | Coughlin | 273/102.1 B |
| 1,412,625 | 4/1962 | Nelson | 273/101 |
| 1,539,648 | 5/1925 | Chester et al. | 273/101 |
| 1,551,858 | 9/1925 | Tratsch | 273/103 |
| 1,604,593 | 10/1926 | Nechamkin et al. | 273/102.1 B |
| 1,731,395 | 10/1929 | Smith | 273/101 |
| 1,862,877 | 6/1932 | Andersen | 273/101 |
| 1,929,327 | 10/1933 | Moray | 273/101 |
| 2,109,860 | 3/1938 | Dahlstrom et al. | 273/101 |
| 2,783,754 | 3/1957 | Heiss | 273/101 |
| 2,830,569 | 4/1958 | Sakuta et al. | 273/101 |
| 2,835,495 | 5/1958 | Lohr et al. | 273/101 |
| 3,228,695 | 1/1966 | Ryan | 273/102.1 C |
| 3,637,213 | 1/1972 | Breslow et al. | 273/101 |
| 3,685,828 | 8/1972 | Getgey | 273/101 |
| 3,845,957 | 11/1974 | Lohr et al. | 273/101 |
| 3,868,113 | 2/1975 | Glass et al. | 273/101 |
| 3,970,311 | 7/1976 | Lohr | 273/101 |

FOREIGN PATENT DOCUMENTS

| | | | |
|---|---|---|---|
| 469347 | 2/1952 | Italy | 273/101 |
| 10855 | 7/1901 | United Kingdom | 273/101 |

*Primary Examiner*—Anton O. Oechsle
*Attorney, Agent, or Firm*—C. Hercus Just

[57] ABSTRACT

A target-type shooting toy having a target area in the rear of a housing and a transparent front wall having a swivel socket in the lower portion to mount swivelly a projectile guide member including a barrel and a projectile return channel, a handle and trigger to move and aim the barrel and actuate a spring-pressed shooting plunger, and projectile return means to return spent projectiles automatically to said return channel for successive movement into the barrel for subsequent shooting. Score recording and audible hit indicating means are actuated by returning projectiles.

7 Claims, 17 Drawing Figures

Fig. 9
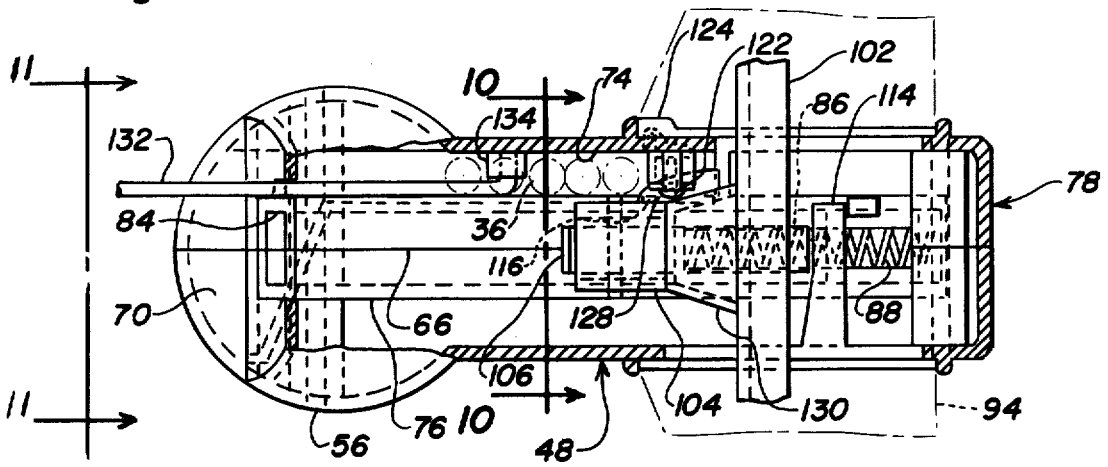
Fig. 10
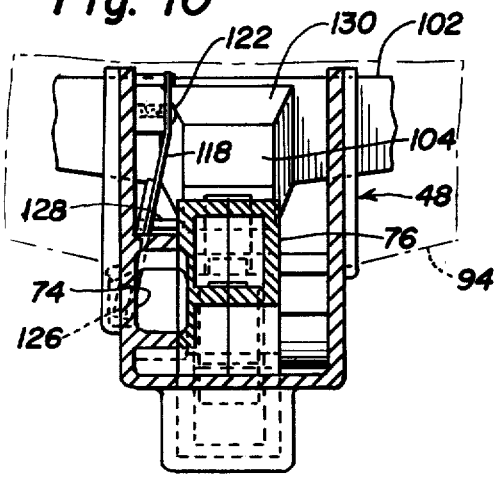
Fig. 11
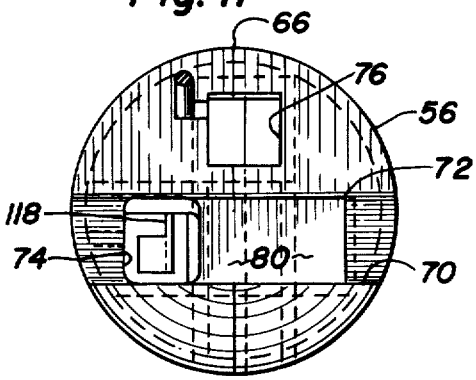
Fig. 12
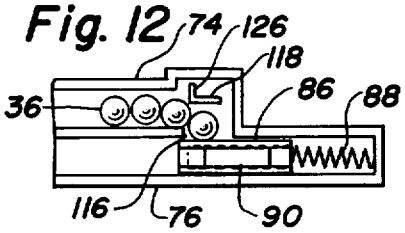
Fig. 13
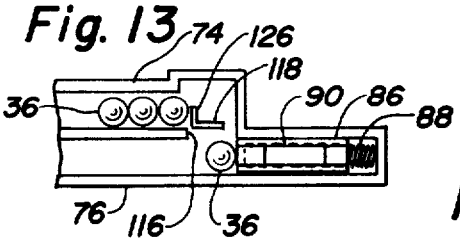
Fig. 14
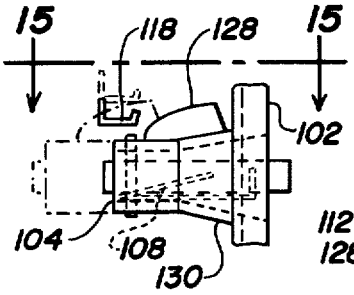
Fig. 15
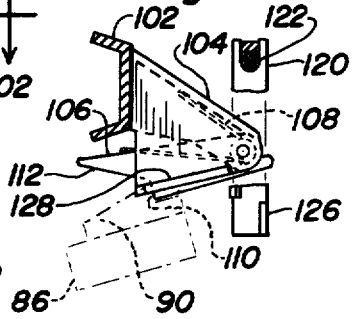
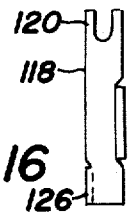
Fig. 16
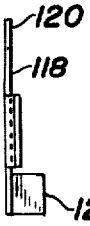
Fig. 17

TARGET-TYPE SHOOTING TOY

BACKGROUND OF THE INVENTION

Target-type shooting toys have been developed previously over a substantial period of time and through the years have been steadily improved to render the same more enjoyable, especially for the amusement and skill of children. Many such devices have very elaborate, substantially horizontal, but slightly sloping, boards with many different types of obstacles thereon which cause addition or substraction from a score which is recorded, steel balls usually being employed and are projected by a spring-pressed, manually operated plunger. Another type of target-type shooting toy to which the present invention pertains, however, comprises a housing which usually has a substantially vertical target area at the rear and a suitable projecting device, commonly in the form of some type of gun, such as pistols, are movably mounted adjacent the front wall of the housing in order that the player may aim the gun toward the target and the shooting of projectiles engages movable target members which either are knocked over and are subsequently restored to upright position or various audible means are hit by the projectile, all for purposes of either providing amusement or recording competing scores when several operators are involved in the shooting operation.

Some of the devices of the foregoing type which have been developed heretofore require the spent projectiles to be loaded manually into the gun and typical examples of such devices are shown in the following patents:

U.S. Pat. No. 1,412,625: Nelson, Apr. 11, 1922
U.S. Pat. No. 1,731,397: Smith, Oct. 15, 1929
U.S. Pat. No. 3,637,213: Breslow, Jan. 25, 1972

Other toys of the aforementioned type which include rear targets and guns or the like at the front of the housing are provided with means for automatically returning the spent projectiles to the barrel of the gun for subsequent shooting thereof and typical examples of this type of device are found in the following U.S. patents:

U.S. Pat. No. 2,109,860: Dahlstrom et al Mar. 1, 1938
U.S. Pat. No. 2,830,569: Sakuta et al Apr. 15, 1958
U.S. Pat. No. 2,835,495: Lohr et al May 20, 1958

Still other variations of such target and gun type shooting toys which have different arrangements from those in the patents cited above are shown in the following U.S. patents:

U.S. Pat. No. 3,845,957, to Lohr et al, dated Nov. 5, 1974, discloses a game in which magnetic balls are moved along a non-magnetic wall by a permanent magnet and said balls are struck by an impact member to cause the ball to be projected toward the target.

U.S. Pat. No. 3,970,311, to Lohr, dated July 20, 1976, shows a housing in which a rotatable target is mounted adjacent the rear wall and a pellet is held by a magnet on a wand adjacent the transparent front wall of the housing and a projecting rod in a gun hits said front wall adjacent the pellet and projects the pellet toward the target.

U.S. Pat. No. 3,868,113, to Glass et al, dated Feb. 25, 1975, shows a game in which a pair of combination guns and targets are mounted respectively adjacent opposite ends of a housing for a pair of contestants respectively to operate the guns, the pellets which are fired by the guns being received from a magazine respectively mounted on each gun and refilling of the magazines occurs manually.

Means for recording scores in shooting games of the type referred to above also have been devised and one typical example thereof is shown in the aforementioned U.S. Pat. No. 2,109,860 to Dahlstrom et al, dated Mar. 1, 1938, in which a scoring wheel is actuated by rachet and escape mechanism energized by electrical means and also including a motor drive.

SUMMARY OF THE INVENTION

It is one of the principal objects of the present invention to provide a target-type shooting toy in which a housing is provided with a target area having movable target members mounted within openings in the target area for engagement by projectiles fired from projectile-launching or firing means swivelly connected at one end adjacent the lower portion of the transparent front wall of a housing, the outer end of said launching means having a pair of transversely-spaced handles thereon to provide clear viewing of the target, said handles extending upwardly and generally simulating handles and trigger mechanism on certain types of automatic guns used on board ships and on aircraft, the projectiles when fired toward the target being returned by one of several types of return mechanism, both gravity operated, one of the return mechanisms receiving spent projectiles which pass through the openings in the target, while the second return means receives projectiles which have not passed through openings in the target, whereby those projectiles which have hit the movable target members and have passed through the openings in the target area are adapted to engage scoring means incident to their return to the projectile launching mechanism and, in addition, audible means, such as a bell, are engaged by the returning projectiles to sound the same.

It is another principal object of the invention to provide improved means for receiving the spent projectiles by the launching mechanism, said receiving means being such as to insure the movement of such projectiles by gravity into a receiving channel which is adjacent a tubular barrel in the launching mechanism, successive entry of the rearmost projectiles in the receiving channel being controlled by simple, but effective mechanism by which individual projectiles are not only moved through an inlet opening in the wall of the barrel, but are actually positively biased or urged into the barrel by simple spring means, such entry occurring only when trigger mechanism on the handles have retracted the firing plunger of the launching menas to a retracted position where the inlet opening in the wall of the barrel is exposed for movement of only a single projectile into the barrel, the retracting movement of the plunger being such as to limit the exposure of the inlet opening for the passage of only a single projectile.

It is a still further important object of the invention to include simple but effective means by which the launching plunger in the barrel is released for movement by the compressed operating spring therefor, the trigger mechanism including a latch on the end thereof opposite the pivoted end in the handle, whereby when the handle and trigger assembly is manually squeezed by the operator, said latch is automatically cammed from engagement with the plunger, and thereby permits the plunger to be instantly advanced in shooting direction by the coiled spring which energizes it.

Still another important objective of the present invention is to provide simple but improved score-indicating means, the same comprising a rotatable drum upon which scoring indicia are included on the exterior thereof and the drum is moved segmentally in advancing direction with respect to the scoring indicia by arranging the return path of the spent projectiles that have passed through the target openings to engage radial vanes with light, but sufficient, force to rotate the drum one segment, for example, and magnetic means of low intensity are mounted adjacent the drum and exert magnetic attraction upon segmentally arranged ferrous means associated with the drum, the force of the magnet being such that the weight of a projectile, such as a ball bearing, upon engaging one of the radial vanes on the scoring drum will overcome the force of the magnet to advance the drum one scoring segment, but when the projectile has moved from contact with the vane, the force of the magnet is such as to arrest successive segmental movements of the drum beyond the single recorded movement thereof.

A still further object of the invention is to form the entire game preferably from molded plastics and the various components are capable of being assembled and held in operative relationship by the employment of a limited number of screws, whereby the overall expense of manufacturing the device is maintained economically commensurate with the attractiveness of the toy resulting, for example, from appropriate art work and selection of colors for the various plastic elements.

Details of the foregoing objects and of the invention, as well as other objects thereof, are set forth in the following specifications and illustrated in the accompanying drawings comprising a part thereof.

BRIEF DESCRIPTION OF THE DRAWINGS

FIG. 9 is a fragmentary sectional plan view of the launching mechanism shown in fIG. 8, as seen on the line 9—9 thereof.

FIG. 10 is a fragmentary vertical sectional elevation of the launching mechanism shown in FIG. 9, as seen on the line 10—10 thereof.

FIG. 11 is a vertical elevation of the left-hand end of the launching mechanism shown in FIG. 9, as seen on the line 11—11 thereof.

FIG. 12 is a fragmentary sectional plan view of a portion of the launching mechanism shown in FIG. 8, as seen on the line 12—12 thereof, and illustrating details of means to move a projectile from the return channel thereof to the receiving end of the barrel of the launching mechanism.

FIG. 13 is a view similar to FIG. 12 but showing a projectile in the barrel and in a position to be launched.

FIG. 14 is a fragmentary partially sectioned plane view of a portion of the launching mechanism shown in FIG. 8, as seen on the line 14—14 thereof.

FIG. 15 is a fragmentary vertical sectional elevation of the details shown in FIG. 14, as seen on the line 15—15 thereof.

FIG. 16 is a front elevation of a leaf spring or plate per se shown in FIGS. 14 and 15.

FIG. 17 is a side elevation of the leaf spring or plate shown in FIG. 16.

DETAILED DESCRIPTION

Figure 1:
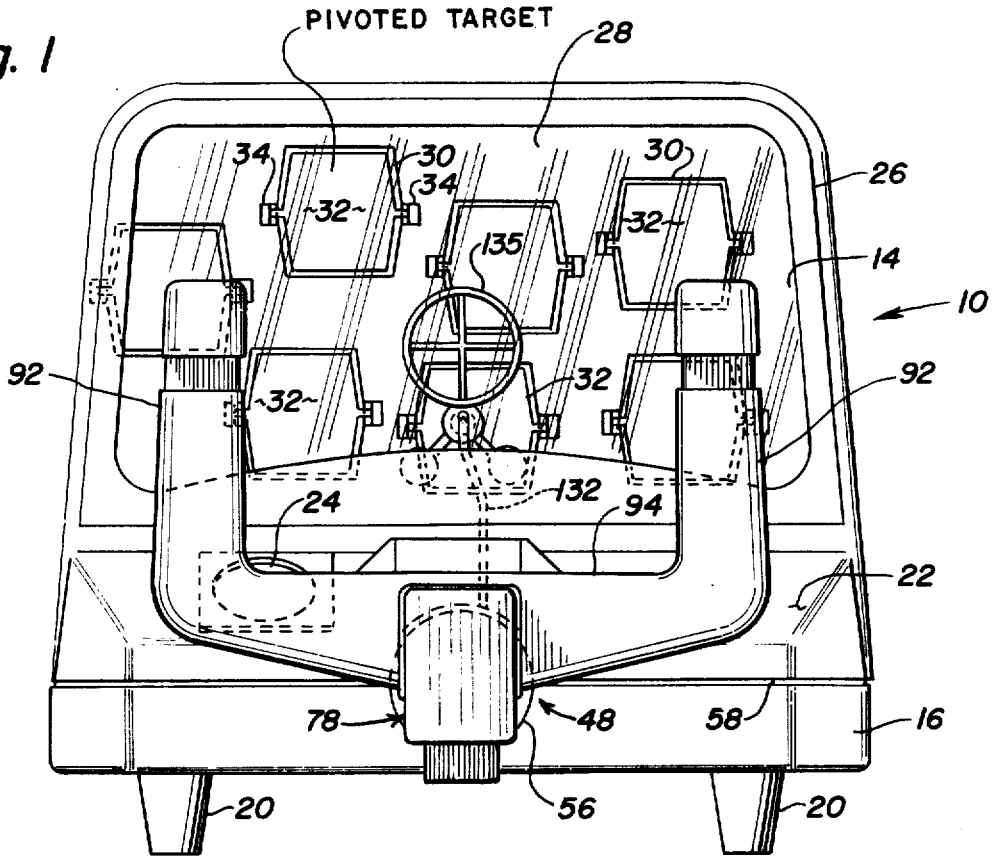
FIG. 1 is a front elevation of a target-type shooting toy embodying the principles of the present invention.
Figure 2:
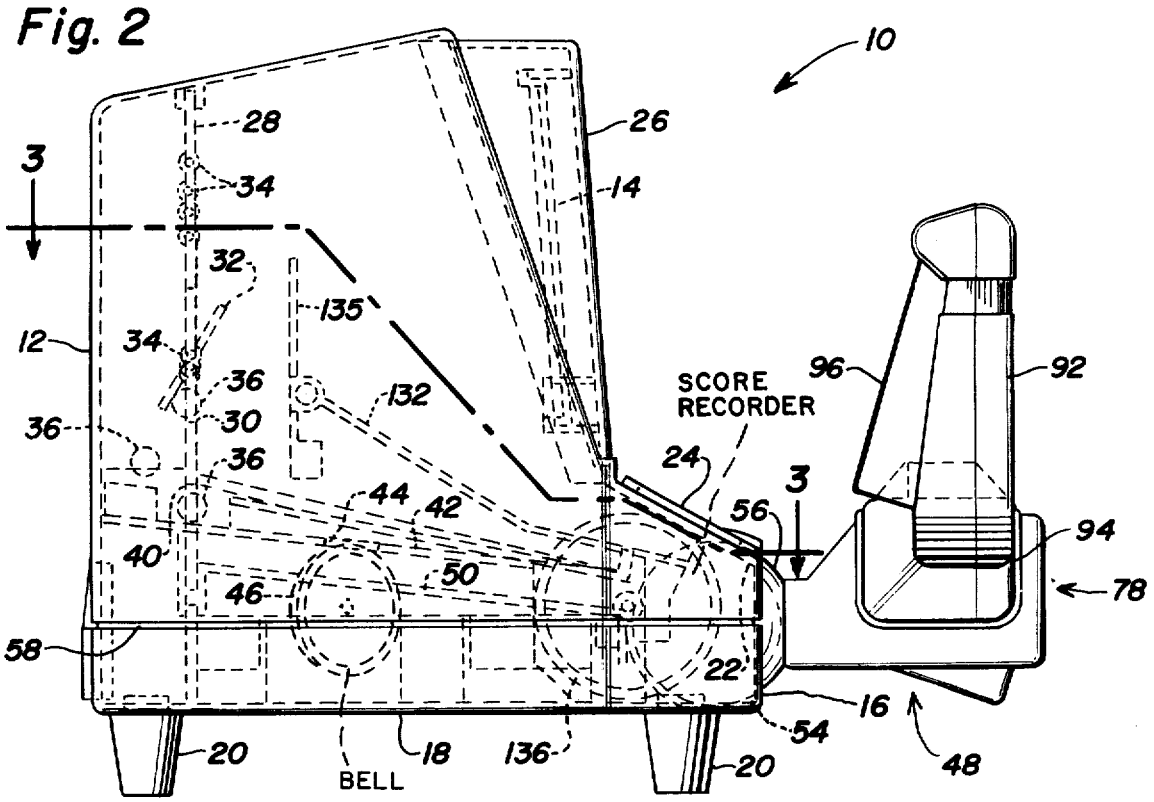
FIG. 2 is a side elevation of the toy shown in FIG. 1.
Figure 3:
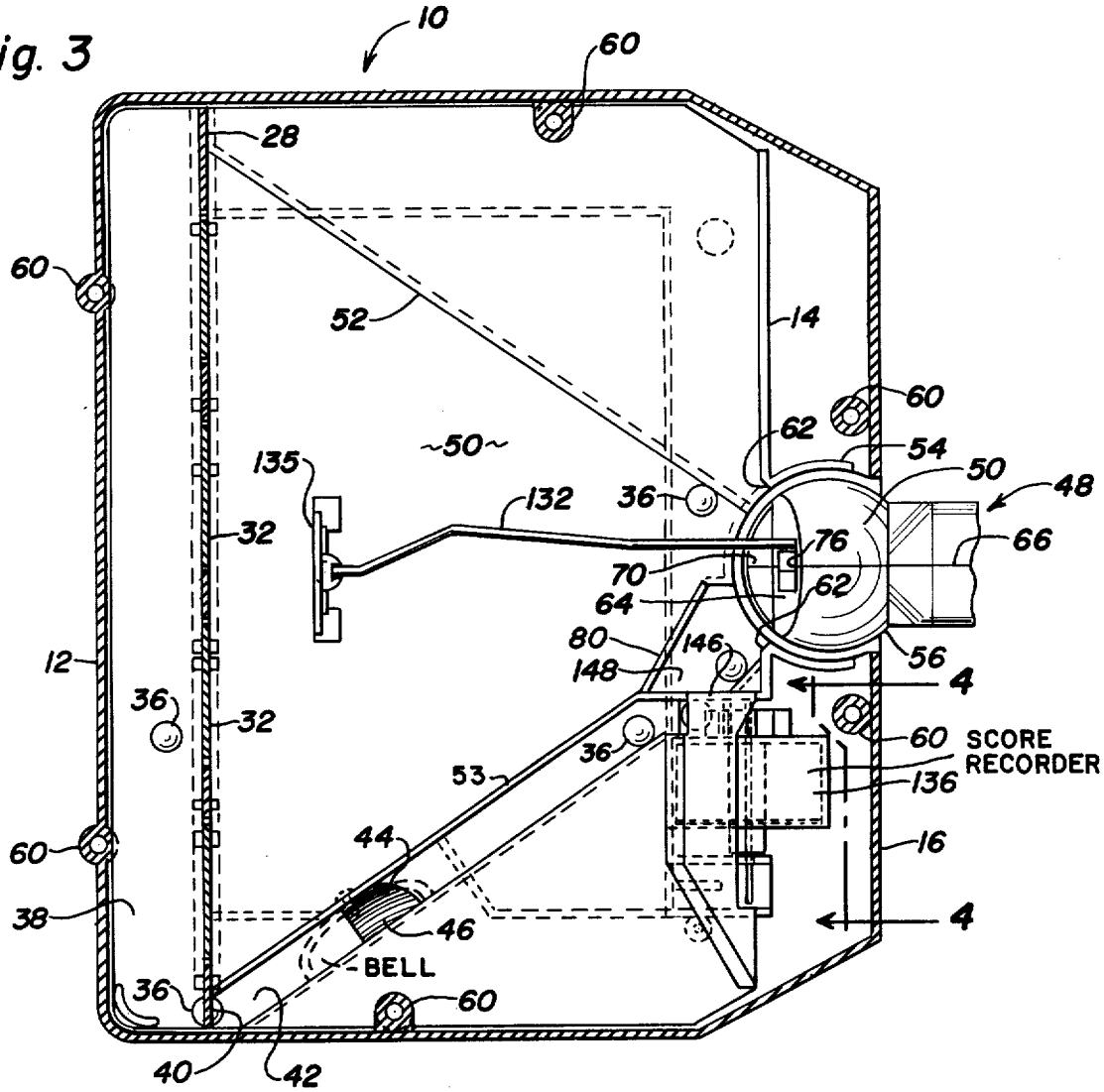
FIG. 3 is a fragmentary sectional plan view of the toy shown in FIG. 2 as seen on the line 3—3 thereof.

Referring particularly to FIGS. 1-3, the target-type shooting toy comprising the present invention includes a housing 10 which forms a complete enclosure for all components of the toy and includes a rear wall 12 which is spaced transversely from a front viewing wall 14 which is transparent and the lower front portion of the housing has a forwardly offset lower portion 16 which preferably is opaque as are all sides, the top and the rear wall of the housing. A bottom wall 18 also extends across the lower portion of the housing and, to facilitate proper operation of the projecting mechanism, the bottom wall 18 is provided with a plurality of short legs 20 to raise the same over any supporting surface upon which the toy is placed. Between the lower edge of the front viewing wall 14 and the upper edge of the offset lower portion 16, an upward and rearwardly sloping housing panel 22 is provided, the same containing a window 24 through which a score-recording device, described in detail hereinafter, is viewed.

The transparent viewing wall 14 preferably is surrounded by an outwardly projecting narrow frame member 26 which contributes to the aesthetic appearance of the toy and various portions thereof are finished in suitable, harmonizing colors, substantially all of the panels and components preferably being formed by molding from suitable types of synthetic resin, with the exception of a limited number of metal components, described in detail hereinafter. Mounted slightly forwardly thereof and parallel to the rear wall 12 is a target area comprising a target board 28, which is provided with a plurality of similar somewhat hexagonal openings 30 within which are disposed target members 32, supported, for example, by pintles projecting from opposite side edges and supported in appropriate bearings 34 formed in the target board 28. The target members 32 preferably have one edge heavier than the opposite edge so that when they are hit by a projectile, they will revolve but ultimately come to rest in a substantially vertical position after the projectile has passed through the opening 32, for example. In order to simulate a realistic shooting game, for example, the front face of the members 32 has a picture of an aeroplane or a similar object thereon, while the rear face may have a picture simulating a bursting shell that can be seen when the target member is rotating after being hit by a projectile but finally will come to rest with the picture on the front face foremost to be viewed by the operator and ready to receive the next shot.

Referring to FIGS. 2 and 3 in particular, when a projectile 36, such as a ball bearing of appropriate size, such as of the order of ¼ inch is projected or shot by means described hereinafter, and the same hits one of the target members 32, it passes through the opening 30 therefor, as shown in exemplary manner in FIG. 2 adjacent the left-hand edge and falls by gravity upon a first projectile return means comprising a gradually sloping ramp 38 which extends between the target board 28 and the rear wall 12, as best seen in FIG. 2, in vertical elevation, and in plan view in FIG. 3, the slope extending downwardly from the upper end as viewed in FIG. 3 toward the lower end as seen therein. Thus, when the spent projectile 36 rolls down the ramp, it passes through an opening 40 in the target board 28, which is at the upper end of an additional gradually downwardly sloping ramp 42 which preferably has an opening 44 therein within which the uppermost portion of an audible device, such as a bell 46, extends, whereby the metallic ball bearing 36 will contact said bell and make a "ting" which adds amusement to the operation of the device, but it will be understood that the projectile continues to roll down the ramp 42 after striking the bell until it exits at the lower end thereof into a projectile guide member 48, details of which are described hereinafter, especially with reference to FIGS. 7–11.

The housing 10 also is provided with a second projectile return means 50 which comprises a substantially V-shaped plate gradually sloping downwardly from the target board 28 toward the projectile guide member 48, the slope thereof being somewhat similar to that of the additional sloping ramp 42 as can be seen especially from FIG. 2. The side edges of the return means 50 are defined by upwardly extending walls 52 and 53 and these confine spent projectiles which have hit fixed areas of the target board 28 and have bounded off of the same to fall onto the surface of the return means 50 and the sidewalls 52 and 53 guide the rolling movement of such returning spent projectiles to the inlet means of the projectile guide member 48.

The housing 10 also is provided in the forwardly offset lower portion 16 at the front of the housing with molded walls forming a generally spherical swivel socket 54, said socket being of a fragmentary nature but, nevertheless, suitable to capably support a generally spherical swivel member 56 which is capable of a substantial amount of universal movement within the socket 54. The walls which form the socket 54 also are composed of sections which are separable, for example, along the parting line 58, where the upper edge of a bottom portion of the housing 10, which is of limited height, meets the lower edge of the more extensive upper portion of the housing 10, said portions being appropriately secured together by a plurality of screws extending into sockets 60, for example, best shown in FIG. 3.

Figure 8:
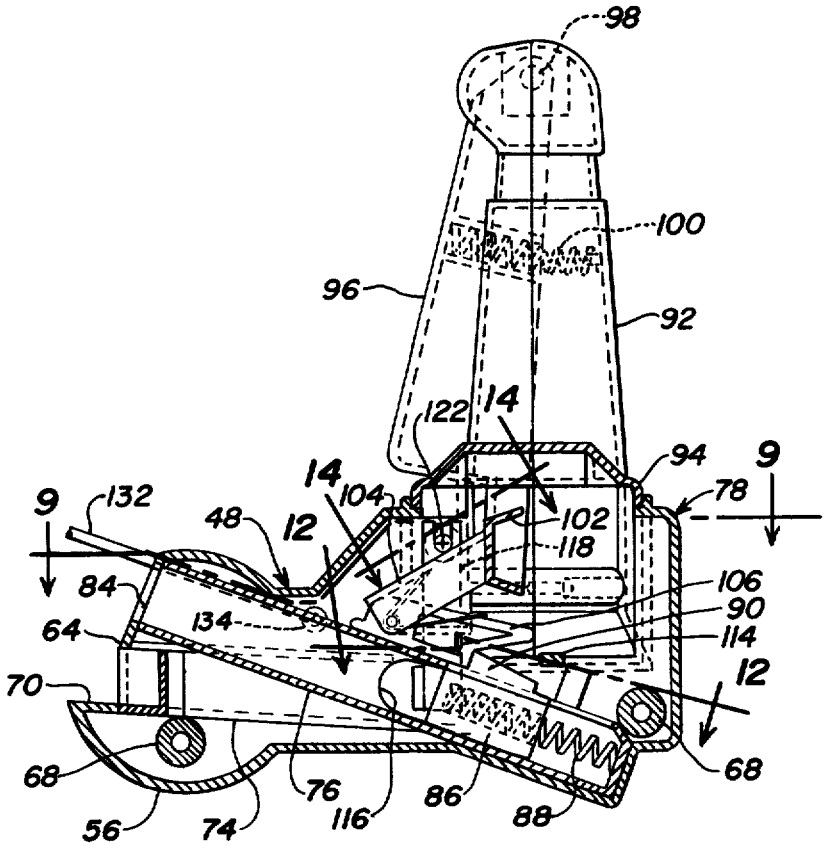
FIG. 8 is a partially vertical sectional view of the launching mechanism shown in FIG. 7, as seen on the line 8—8 thereof.

The portions of the walls of the swivel socket 54 which are nearest the interior of the housing terminate to form an opening defined by the side edges 62, see FIG. 3, for purposes of forming an inlet opening to the swivel member 50, the innermost face 64 of which is disposed inwardly from what would otherwise be a spherical outermost surface of the member 56, and the projectile guide member 48 upon which the swivel member 56 is formed preferably is formed in two parts which abut along the line 66 in FIG. 3 and said parts are secured operatively together by a plurality of screws 68, which are clearly seen in FIG. 8.

Figure 7:
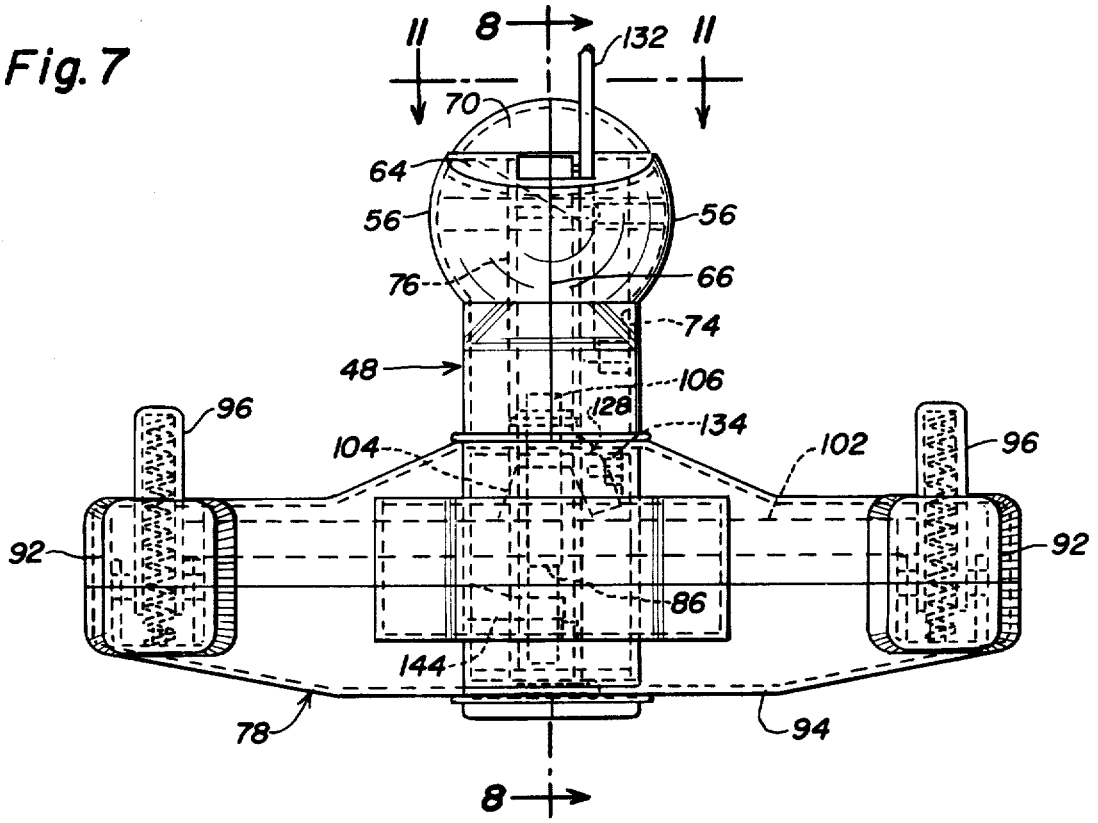
FIG. 7 is a plan view on an enlarged scale of the projectile launching portion of the toy, shown in the preceding figures.

Referring particularly to FIGS. 7 and 8, it will be seen that the swivel member 56 also has a forward narrow shelf 70 which normally is more or less level with the adjacent narrow lower end of the second projectile return means 50 so as to receive returning projectiles 36 through a generally rectangular opening 72 which is best shown in FIG. 11, comprising a front elevation of the generally spherical swivel member 56. The opening 72 encompasses the receiving end of a substantially square projectile return channel 74 which extends longitudinally part way along the projectile guide member 48, as best seen in FIG. 9, the same being formed by suitably molded walls in the several sections comprising the projectile guide member 48 which is secured by the screws 68.

Also formed within the projectile guide member 48, is a barrel 76, which is tubular, preferably substantially square in cross-section, as shown in FIGS. 10 and 11 in particular. From FIG. 8, it also will be seen that the axis of the barrel 76 is at an acute angle to the axis of the projectile return channel 74 which, in turn, is substantially parallel to the longitudinal axis of the portion of the projectile member 48 which is between the swivel member 56 and the handle assembly 78 on the opposite end thereof. Therefore, due particularly to the fact that the swivel member 56 is mounted in the lower portion of the front wall arrangement of the housing 10, and all portions of the target board 28 being in an elevation above the axis of the swivel member 56, aiming of the barrel 76 will occur in an upwardly sloping direction toward the target board 28, whereby the projectile return channel 74 also will normally extend downwardly and outwardly from the axis of the swivel member 56, in a direction away from the target board 28. Accordingly, spent returning projectiles will readily roll down the sloping ramp 42 and the projectile return means 50 toward the shelf surface or lip 70, solely by gravity, for direct passage, either into the mouth of the return channel 74 or they will engage the laterally and inwardly sloping guide surface 80 and thereby be directed into the return channel 74 until a plurality thereof automatically will be contained within the inner end portion of the channel 74 as shown in exemplary manner in FIG. 9. Additional deflecting wall means 82, shown in FIG. 3, also will aid in directing the projectiles rolling along the surface of return means 50 toward the shelf 70, for the aforementioned purposes.

Projectiles are fired or shot from the barrel 76 through the exit opening 84 by a ram or plunger 86, best shown in FIG. 8, which contains part of a compression spring 88 disposed in a rearwardly extending socket in the plunger 86, the upper surface of the plunger having a latching lug 90 extending therefrom which has a downwardly and forwardly sloping upper surface. The spring 88 is such that only limited compression thereof which is effected by retraction of the plunger 86 is sufficient to energize it to cause the plunger to exert instant and substantial force upon a projectile in the barrel 76 and shoot it from the exit or mouth 84 of the barrel with substantial force against the target area. Aiming of the barrel 76, retraction of the plunger 86 and firing a projectile is accomplished by the following mechanism:

The handle assembly 78 preferably comprises a pair of substantially perpendicular handle members 92 which preferably extend upwardly from a transverse member 94 which is hollow and contains substantial space for purposes to be described. The handle members 92 also are hollow and the walls thereof nearest the front viewing wall 14 of the housing have elongated vertical openings which receive elongated trigger members 96 which are connected by pivots 98 at the upper ends thereof to the upper ends of the handle members 92. Compression springs 100 normally maintain the lower ends of the trigger members 96 in expanded position with respect to the handles 92. Further, the lower ends of the trigger members 96 are connected by a transverse cross-bar 102 which is relatively narrow and amply movable within the aforementioned space in the transverse member 94 that connects the handle members 92. Intermediately of the ends of the cross-bar 102 is an arm 104 which projects therefrom in a sloping manner downwardly toward the barrel 76, as clearly shown in FIG. 8, for purposes of supporting pivotally at the lower end thereof a latch member 106, the free end of which is normally biased downwardly by an appropriate spring 108 to insure engagement of the latching step 110 with the latching face of the lug 90 as clearly shown in FIG. 15.

The transverse spacing of the handle members 92 affords clear vision therebetween so that the operator of the toy can simulate the firing of an actual machine gun or the like mounted upon ship board or an aeroplane, by grasping the handles 92 simultaneously with both hands and, upon squeezing the trigger members 96, the latch member 106 retracts the plunger 86 to compress the spring 88 and such movement induces the introduction of a projectile into the barrel adjacent the forward face of the plunger 86 by means described hereinafter and, continued squeezing of the trigger members 96 causes the cam face 112 on the latch member 106, see FIG. 15, to engage a fixed lug or detent 114, which is fixedly supported by one wall of the central portion of the transverse member 94, see FIG. 8, whereby the completion of the retraction of the plunger 86 cams the latch member 106 from engagement with the plunger and thereby frees the same for instantaneous forward movement thereof by the spring 88 to effect the forceful projection of a projectile from the barrel 76 toward the target area.

Movement of projectiles from the return channel 74 to the barrel 76 occurs through an inlet opening 116, shown best in FIGS. 8 and 9, 12 and 13, in one sidewall of the barrel 76, which is adjacent the innermost end of the return channel 74. When the plunger 86 is in the forwardmost position, as viewed in FIG. 12, it will be seen that it closes the opening 116, but when the plunger has been retracted, the opening 116 is unobstructed and the projectile 36 can move into the barrel 76 and in position to be engaged by the plunger 86. Such movement of the projectile as aforesaid is positively assured by means of a spring blade 118, which is actually a leaf spring, the upper end 120 of which is secured by a suitable screw 122, see FIGS. 9 and 15, to a wall portion 124 of channel 74. The lower end of the spring 118 has a lateral extension 126 which is arranged to project at least partially across the inner end of the channel 74, as shown in FIG. 13, when the spring 118 is in obstructing position across the inlet opening 116. Under such circumstances, no additional projectiles 36 can move into the barrel 76 until after the lower end of the spring 118 has been moved to the position shown in FIG. 12, and this is accomplished by a cam 128, best shown in FIG. 14, which extends outwardly from one side of the portion 130 of arm 104 which is nearest the cross-bar 102. Forward camming movement of the cam 128 is effected when the trigger members 96 move forwardly to the inoperative position thereof, such as shown in FIG. 8.

Under normal circumstances, a limited number, such as six or eight of the projectiles 36 are provided in the game. Due to the fact that the housing 10 completely encloses the interior of the game and no escape of the balls can occur, coupled with the fact that when the housing is supported upon a horizontal supporting surface by means of the legs 20 and is substantially horizontal, the various projectile return means will insure that all of the spent projectiles ultimately and quickly will return to the receiving channel 74 and the aforementioned normally, at least slightly, sloping position of said channel, as viewed especially in FIG. 8, will insure that the accumulation of returned projectiles will be disposed in the innermost portion of the channel 74 and thus in position for the innermost projectile to be extended through the inlet opening 116 of the barrel which movement thereof into the barrel is insured by the spring 118.

To further supplement the simulated realism of the operation of the toy, the projectile guide member 48 is provided with a wire-type arm 132, which extends forwardly therefrom and is appropriately anchored in a lug 134, shown in FIG. 9. A swivelly supported sight member 135 is on the outer end of arm 132.

Figure 5:
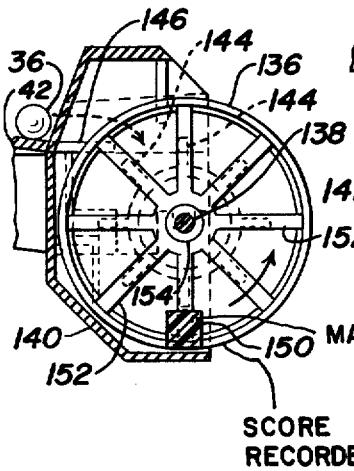
FIG. 5 is a fragmentary vertical sectional view of the portion of the toy shown in FIG. 4, as seen on the line 5—5 thereof.
Figure 4:
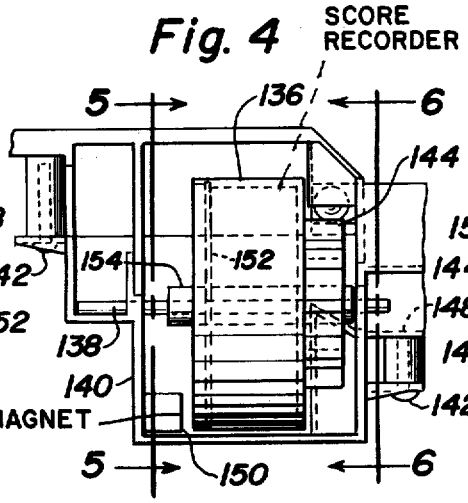
FIG. 4 is a fragmentary vertical elevation of a portion of the toy shown in FIG. 3, as seen on the line 4—4 thereof.
Figure 6:
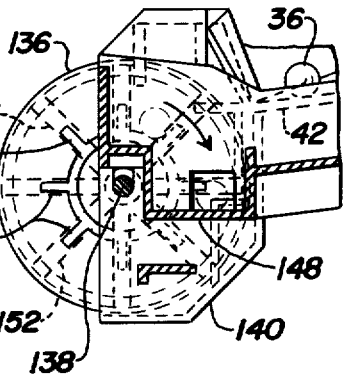
FIG. 6 is a vertical sectional view of the portion of the toy shown in FIG. 4, as seen on the line 6—6 thereof.

As indicated above, the toy is also provided with score displaying and recording means, details of which are best shown in FIGS. 4—6, but are also included in limited manner in FIGS. 2 and 3. Essentially, the score-recording means comprises a cylindrical drum 136 which may be formed from plastics and the same is freely rotatable upon an axle 138, the opposite ends of which are mounted in suitable sockets in the lower portion of the housing 10 comprising a sub-frame 140, secured by screws 142, to the main portion of the frame of the housing. The outer surface of drum 136 contains suitable indicia, not shown, segmentally arranged therearound and movement of the drum 136 in stepwise manner is effected by a sort of paddle wheel arrangement comprising short radial vanes 144, which project from one side of the drum 136 and are adapted to be engaged by a projectile 36 when it reaches the lower end of the additional sloping ramp 42 since said projectiles will comprise those which have passed through the openings 30 in the target board as a result of having hit the movably supported target members 32. It is only those projectiles which are intended to actuate the score-recording means and said projectiles move through an opening 146 at the terminal end of ramp 42, best shown in FIG. 5. The weight of the projectile 36 is such that when it engages between the upwardly extending pair of vanes 144 as shown in FIG. 5, it will cause the drum to rotate counterclockwise as indicated by the directional arrow in said figure, whereupon the ball will rotate the drum 136 one segment and be deposited upon guide surface 148 for subsequent deposit upon the shelf or lip 70 and from there into the return channel 74.

Segmental movement of the drum 136 is insured by magnetic means which preferably comprise a permanent magnet 150 which is supported by the sub-frame 140 adjacent the side of the drum 136 opposite that to which the vanes 144 are connected. The drum 136 preferably is cup-shaped and the bottom of the cup extends vertically, as viewed in FIG. 4, for purposes of the vanes 144 being integrally molded therewith, while the opposite end of the drum 136 is open and within said opening, a set of radially extending fingers 152 which are formed from suitable ferrous material, are supported upon a portion of the hub 154 which is axially disposed within the drum 136.

The proximity of the magnet 150 to the ferrous fingers 152 will, due to the limited magnetic force exerted by the permanent magnet 150, stop the movement of the drum after the same has been advanced a predetermined amount comprising the peripheral distance between adjacent fingers 152, and thereby will expose the advanced indicia through the window 24 in the sloping panel 22 of the housing 10. The force of the magnet 150 and the weight of the projectiles 36 are coordinated suitably to effect the limited advancing movement and then the halting of said movement of the drum 136 as described above.

In operating the game comprising the present invention, a child or other operator, preferably places the housing upon a horizontal supporting surface upon which the short legs 20 rest. Then, by grasping the handles 92, respectively, in opposite hands and squeezing the trigger members 96, a projectile will be shot automatically from the barrel 76 toward the target area as the projectile guide member 48 is swivelly moved by means of the handles 92 in any direction desired, the aiming of the guide member being at least somewhat aided by means of the sight device 135. The principal object of using the toy is to have the projectiles hit the movable target members 32, whereby the spent projectiles pass through the openings 30 and then move down the sloping ramp 38 of the first return means with continued movement along the additional sloping ramp 42, incidentally sounding the audible means, such as bell 48, and ultimately contacting the score-indicating and recording unit, primarily comprising the drum 136, after which the projectiles are returned to the return channel 74 automatically, primarily by gravity. Those projectiles which do not hit the target members 32 and thereby bound off the stationary portions of the target board 28 will be returned by the sloping second return means 50 for reception within the return channel 74 and the slightly sloping nature of the channel 74 will insure that all of the returning projectiles are disposed in the inner end portion thereof for ready positioning within the barrel 76 by passage through the inlet opening 116 in one sidewall thereof.

Each time the trigger members 96 are squeezed to actuate the plunger 86, a projectile will be discharged from the exit 84 of the barrel 76 toward the target area and repeated squeezings of the trigger members 96, even though in a rapid manner, will continuously result in projectiles being fired toward the target so that extensive periods of operation of the toy can occur without mishap and without any of the projectiles being lost or any manual loading of magazines or other similar operations are totally unnecessary.

The various components of the toy being molded from suitable plastic material of durable and rigid type insures long life to the toy, especially since there are substantially no parts which are subjected to any appreciable wear resulting from the use thereof and realistic simulation of target shooting of actual firing of military-type automatic weapons is achieved.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A target-type shooting toy comprising in combination:

(a) a housing adapted to be supported adjacent a horizontal surface and having a front wall including a transparent upper portion and a target area rearwardly spaced therefrom and a base wall supported on short legs for positioning said base very close to said surface, (b) a swivel spherical socket mounted in the lower portion of said front wall adjacent said base wall, (c) a generally spherical swivel member complementary to said swivel socket and mounted therein for support and provided with a projectile inlet passage means and a projectile return channel extending therefrom away from said socket, (d) a projectile guide member mounted upon said spherical swivel member and projecting outwardly therefrom away from said target area, said guide member having an elongated barrel fixed adjacent one side of said projectile return channel and a projectile inlet opening extending through a wall of said barrel from said return channel, (e) handle means extending laterally upward from the outer end of said projectile guide member to permit ready universal swivelling of said swivel member relative to said base wall and carry said barrel and inlet passage means therewith, (f) a trigger member pivoted at one end to the upper end of said handle means, (g) a spring-pressed plunger mounted within the outermost portion of said projectile guide member extending away from said spherical swivel member and normally covering said projectile inlet opening in said projectile guide, (h) plunger cocking means carried by the lower end of said trigger member and including a movable latch provided with a cam surface and engageable with said plunger and operable to move the same toward the outer end of said projectile guide member to compress said spring when said trigger member is moved in cocking direction, (i) a latch actuating member on said projectile guide member fixed relative thereto and engageable by said cam surface on said latch during continued cocking movement of said trigger and operable to disengage said latch from said plunger when said spring has been compressed a predetermined extent, thereby to free said plunger to discharge a projectile from said barrel toward said target area, (j) target means on said target area adapted to be hit by a projectile discharged as aforesaid, (k) projectile return means in said housing operable to return spent projectiles to said projectile inlet means, and (l) means opposite said projectile inlet opening in said projectile guide member operable to urge a projectile into said barrel when said plunger has been moved to compress said spring, whereby when said latch has disengaged said plunger, said spring instantly urges it in a direction to shoot a projectile toward said target.

2. The toy according to claim 1 further including a sight member comprising an arm of small cross-section mounted at one end upon said spherical member and projecting outwardly and axially from the outer end of said projectile guide member toward said target area and supporting a swivelled sight device substantially perpendicularly upon the outer end thereof.

3. The toy according to claim 1 in which said target means includes target elements pivotally supported upon horizontal axes within openings in a target board for movement when hit by a projectile, whereby said projectile then passes through one of said openings, and said housing further including return guide means extending forwardly from said target board and comprising a broad ramp to receive spent projectiles that have passed through said openings and extending therefrom in sloping manner toward said spherical swivel member and further including side walls on said ramp extending angularly from said target board toward said swivel member and thereby being operable to guide said projectiles automatically and solely by gravity to said projectile guide member for reuse thereby.

4. The toy according to claim 1 in which said handle means further comprises a pair of handle members respectively extending upwardly from opposite ends of a transverse member attached to the outer end of said projectile guide member, each of said handle members having a trigger member pivoted to the upper ends thereof, a cross-bar extending between and connected to the lower ends of said trigger members, and said movable latch of said plunger cocking means being supported by said cross-bar intermediately of the ends thereof, whereby the space between said handle members affords an operator of the game a clear view of the target area.

5. The toy according to claim 1 in which said projectile return channel extends within said projectile guide member and is substantially in parallel relation to the axis of said member and said elongated barrel extends upwardly and rearwardly from said handle toward the target area, whereby the mounting of said spherical swivel member within said swivel socket in the lower portion of the front wall of said housing normally disposes said projectile return channel in a sloping direction extending downwardly and outwardly relative to said front wall of said housing to permit spent projectiles returning to said projectile return channel from said projectile return means in said housing to roll by gravity into said channel to the full depth thereof.

6. The toy according to claim 5 in which said means opposite said projectile inlet opening in said projectile guide member comprises a spring blade supported by said member opposite said projectile inlet opening in said member comprising an opening in the wall of said barrel, whereby when the movement of said plunger in retracting direction to compress the spring therefor moves said plunger past said opening in the wall of said barrel, said spring blade automatically urges the rearmost projectile within said projectile return channel through said opening and into said barrel for projection thereof by said plunger when the latter is released from said latch of said cocking means.

7. The toy according to claim 1 in which the end of said projectile return channel in said spherical swivel member has an angular guide wall in said member sloping laterally and inwardly to facilitate the return of projectiles into said channel.

* * * * *